US008493168B2

(12) United States Patent
Tsai et al.

(10) Patent No.: US 8,493,168 B2
(45) Date of Patent: Jul. 23, 2013

(54) ASYMMETRIC DIFFERENTIAL INDUCTOR

(75) Inventors: Ming-Fan Tsai, Taichung (TW); Kuan-Yu Chen, Taichung (TW); Bo-Shiang Fang, Taichung (TW); Hsin-Hung Lee, Taichung (TW)

(73) Assignee: Siliconware Precision Industries Co., Ltd., Taichung (TW)

( * ) Notice: Subject to any disclaimer, the term of this patent is extended or adjusted under 35 U.S.C. 154(b) by 0 days.

(21) Appl. No.: 13/222,231

(22) Filed: Aug. 31, 2011

(65) Prior Publication Data

US 2012/0299683 A1 Nov. 29, 2012

(30) Foreign Application Priority Data

May 26, 2011 (TW) ..... 100118434 A

(51) Int. Cl.
*H01F 5/00* (2006.01)
*H01F 27/28* (2006.01)

(52) U.S. Cl.
USPC ..... 336/200; 336/22; 336/223; 336/226

(58) Field of Classification Search
USPC ..... 336/200, 208, 222, 223, 226, 232
See application file for complete search history.

(56) References Cited

U.S. PATENT DOCUMENTS 6,577,219 B2 * 6/2003 Visser ..... 336/200
7,215,217 B2 * 5/2007 Ezzeddine ..... 333/25
7,253,712 B1 * 8/2007 Papananos ..... 336/200
7,312,684 B2 * 12/2007 Aoki ..... 336/200
7,489,218 B2 * 2/2009 Lee ..... 336/84 C
7,751,793 B2 * 7/2010 Castillejo et al. ..... 455/323
7,940,152 B1 * 5/2011 Kim et al. ..... 336/180
8,203,416 B2 * 6/2012 Ezzeddine ..... 336/200
8,339,233 B2 * 12/2012 Tsai et al. ..... 336/200
2005/0077992 A1 * 4/2005 Raghavan et al. ..... 336/200

* cited by examiner

*Primary Examiner* — Mohamad Musleh
*Assistant Examiner* — Joselito Baisa
(74) *Attorney, Agent, or Firm* — Edwards Wildman Palmer LLP; Peter F. Corless; Steven M. Jensen

(57) ABSTRACT

An asymmetric differential inductor includes first and second conductive wirings spirally disposed on a substrate having a first input terminal, a second input terminal, a ground terminal, and a central conductive wiring. The central conductive wiring has a central contact connecting the ground terminal and a central end away from the ground terminal. The first conductive wiring extends across the central conductive wiring and has a first contact connecting the first input terminal and a first end connecting the central end. The second conductive wiring extends across the central conductive wiring and interlaces with the first conductive wiring and has a second contact connecting the second input terminal and a second end connecting the central end. Corresponding portions of wiring sections of the first and second conductive wirings at opposite sides of the central conductive wiring are asymmetrical to one another to thereby save substrate space and facilitate circuit layout.

11 Claims, 2 Drawing Sheets

ASYMMETRIC DIFFERENTIAL INDUCTOR

CROSS-REFERENCE TO RELATED APPLICATIONS

This application claims under 35 U.S.C. §119(a) the benefit of Taiwanese Application No. 100118434, filed May 26, 2011, the entire contents of which is incorporated herein by reference.

BACKGROUND OF THE INVENTION

1. Field of the Invention

The present invention relates to differential inductors, and, more particularly, to a differential inductor applicable to asymmetric circuit designs.

2. Description of Related Art

Differential inductors are important passive components in differential amplifiers, and the center-tap kind is a common type of differential inductor.

FIG. 1 is a structural diagram of a center-tap differential inductor 1. Referring to FIG. 1, the center-tap differential inductor 1 has a central conductive wiring 10, a first spiral conductive wiring 11 and a second spiral conductive wiring 12. One end of the first spiral conductive wiring 11 has a first input port 110 and the other end of the first spiral conductive wiring 11 has a contact 111 connected with the central conductive wiring 10. One end of the second spiral conductive wiring 12 has a second input port 120 and the other end of the second conductive wiring 12 has a contact 121 connected with the central conductive wiring 10. Further, the first spiral conductive wiring 11 has a third spanning portion 13 extending across the second spiral conductive wiring 12, and the second spiral conductive wiring 12 has a fourth spanning portion 14 extending across the first spiral conductive wiring 11.

However, the differential inductor 1 is designed to be nearly symmetric and only suitable to be applied in symmetric circuit designs such as specific differential amplifiers or Gilbert mixers. Therefore, in order to design an asymmetric inductor, wherein the inductance values of two inductors are different from each other, two separate inductors are required, thus increasing the overall circuit area. Further, with regards to manufacturing, a large substrate space is required for the circuit layout of a center-tap differential inductor 1, thereby increasing the manufacturing cost.

As a result, it is imperative to provide an asymmetric differential inductor so as to overcome the above-described drawbacks.

SUMMARY OF THE INVENTION

Accordingly, the present invention provides an asymmetric differential inductor for being disposed on a substrate having a first input terminal, a second input terminal, a ground terminal and a central conductive wiring, wherein the first input terminal and the second input terminal are disposed on left and right sides of the central conductive wiring, respectively, and the central conductive wiring has a central contact connected with the ground terminal and a central end disposed away from the ground terminal. The inductor comprises: a first conductive wiring extending across the central conductive wiring so as to be spirally disposed on the substrate and having a first contact connected with the first input terminal and a first end connected with the central end; and a second conductive wiring extending across the central conductive wiring and interlacing with the first conductive wiring so as to be spirally disposed on the substrate and having a second contact connected with the second input terminal and a second end connected with the central end, wherein a portion of wiring sections of the second conductive wiring and a corresponding portion of wiring sections of the first conductive wiring disposed at the opposite sides of the central conductive wiring are asymmetric to one another.

In an embodiment, the first conductive wiring spirally extends from the first contact into the first end in a clockwise manner, and the second conductive wiring spirally extends from the second contact into the second end in a counterclockwise manner.

In another embodiment, the first conductive wiring can comprise a first spanning portion extending across the second conductive wiring and a second spanning portion extending across the second conductive wiring and the central conductive wiring. The first conductive wiring can further comprise a first wiring section and a second wiring section disposed at the left and right sides of the central conductive wiring, respectively, and in parallel to the central conductive wiring. As such, the first conductive wiring can extend sequentially through the first wiring section, the first spanning portion, the second wiring section and the second spanning portion to the first end. Furthermore, the second conductive wiring can comprise a fourth wiring section and a fifth wiring section disposed on the right and left sides of the central conductive wiring, respectively, and in parallel to the central conductive wiring. Therein, the first and fourth wiring sections are asymmetric to one another along the central conductive wiring, and the second and fifth wiring sections are asymmetric to one another along the central conductive wiring.

The second conductive wiring can further comprise a third spanning portion and a fourth spanning portion extending across the first conductive wiring at the left side of the central conductive wiring. For example, the third spanning portion and the fourth spanning portion can extend across the first wiring section of the first conductive wiring. As such, the second conductive wiring extends sequentially through the fourth wiring section, the third spanning portion, the fifth wiring section and the fourth spanning portion to the second end.

In addition, the first conductive wiring can comprise a third wiring section disposed at the left side of the central conductive wiring and in parallel to the central conductive wiring, and the second conductive wiring can comprise a sixth wiring section disposed at the right side of the central conductive wiring and in parallel to the central conductive wiring, wherein the third and sixth wiring sections are symmetric to one another along the central conductive wiring.

According to the present invention, the first wiring section of the first conductive wiring and the fourth wiring section of the second conductive wiring are asymmetric to one another along the central conductive wiring, and the second wiring section of the first conductive wiring and the fifth wiring section of the second conductive wiring are also asymmetric to one another along the central conductive wiring. Therefore, the present invention provides an asymmetric differential inductor to save substrate space as compared with the conventional center-tap inductor, thereby increasing flexibility in circuit layout.

DETAILED DESCRIPTION OF PREFERRED EMBODIMENTS

The following illustrative embodiments are provided to illustrate the disclosure of the present invention and its advantages, these and other advantages and effects being apparent to those in the art after reading this specification.

Figure 1:
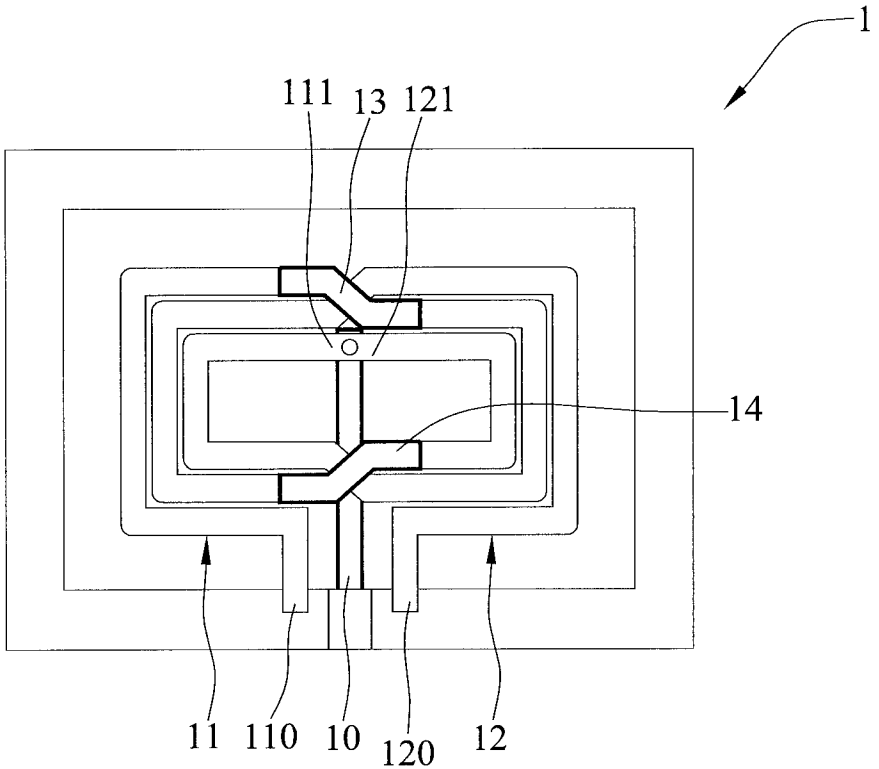
FIG. 1 (PRIOR ART)
FIG. 1 is a structural diagram of a conventional center-tap differential inductor.
Figure 2:
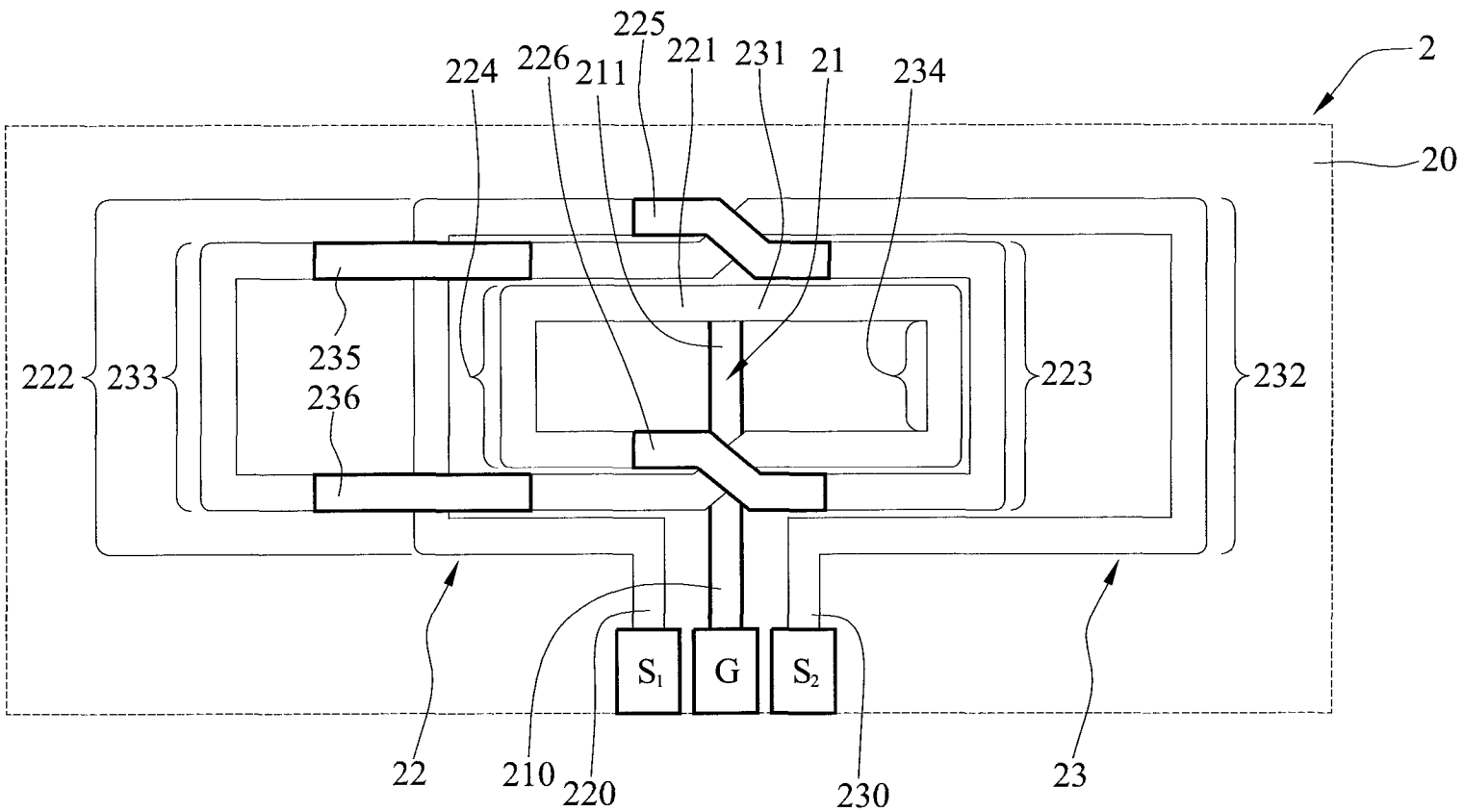
FIG. 2 is a structural diagram of an asymmetric differential inductor of the present invention.

FIG. 2 is a structural diagram of an asymmetric differential inductor of the present invention. Referring to FIG. 2, the asymmetric differential inductor 2 is disposed on a substrate 2 having a first input terminal $S_1$, a second input terminal $S_2$, a ground terminal G and a central conductive wiring 21. The first input terminal $S_1$ and the second input terminal $S_2$ are disposed at left and right sides of the central conductive wiring 21, respectively, and the central conductive wiring 21 has a central contact 210 connected to the ground terminal G and a central end 211 disposed away from the ground terminal G. In addition, the asymmetric differential inductor 2 has a first conductive wiring 22 and a second conductive wiring 23.

The first conductive wiring 22 extends across the central conductive wiring 21 so as to be spirally disposed on the substrate 20. The first conductive wiring 22 has a first contact 220 connected with the first input terminal $S_1$ and a first end 221 connected with the central end 211. Further, the first conductive wiring 22 extends from the first contact 220 to the first end 221 in a clockwise spiral, spanning back and forth across the central conductive wiring 21. In particular, starting from the first contact 220, the first conductive wiring 22 has a first wiring section 222, a second wiring section 223 and a third wiring section 224 sequentially formed and in parallel to the central conductive wiring 21.

The second conductive wiring 23 extends across the central conductive wiring 21 and interlaces with the first conductive wiring 22 so as to be spirally disposed on the substrate 20. The second conductive wiring 23 has a second contact 230 connected with the second input terminal $S_2$ and a second end 231 connected with the central end 211. Further, the second conductive wiring 23 extends from the second contact 230 to the second end 231 in a counterclockwise spiral, spanning back and forth across the central conductive wiring 21. In particular, starting from the second contact 230, the second conductive wiring 23 has a fourth wiring section 232, a fifth wiring section 233 and a sixth wiring section 234 sequentially formed and in parallel to the central conductive wiring 21.

Therein, a portion of the wiring sections of the second conductive wiring 23 and a corresponding portion of the wiring sections of the first conductive wiring 22 disposed on the opposite sides of the central conductive wiring 21 are asymmetric to one another. Whereas the third wiring section 224 of the first conductive wiring 22 and the sixth wiring section 234 of the second conductive wiring 23 can be symmetric to one another along the central conductive wiring 21, the first wiring section 222 of the first conductive wiring 22 can be located between the third wiring section 224 of the first conductive wiring 22 and the fifth wiring section 233 of the second conductive wiring 23 such that the distance between the first and fifth wiring sections 222, 233 can be greater than the distance between the first and third wiring sections 222, 224, and the second wiring section 223 of the first conductive wiring 22 can be located between the fourth wiring section 232 and the sixth wiring section 234 of the second conductive wiring 23 such that the distance between the second and fourth wiring sections 223, 232 can be greater than the distance between the second and sixth wiring sections 223, 234. In other words, the first and fourth wiring sections 222, 232 can be asymmetric to one another along the central conductive wiring 21, and the second and fifth wiring sections 223, 233 can be asymmetric to one another along the central conductive wiring 21.

The first conductive wiring 22 can further have a first spanning portion 225 disposed between the first and second wiring sections 222, 223 and extending across the second conductive wiring 23, and a second spanning portion 226 disposed between the second and third wiring sections 223, 224 and extending across the second conductive wiring 23 and the central conductive wiring 21. Further, the second spanning portion 226 is located between the first spanning portion 225 and the first contact 220.

The second conductive wiring 23 can further have a third spanning portion 235 disposed between the fourth and fifth wiring sections 232, 233 and extending across the first conductive wiring 22, and a fourth spanning portion 236 disposed between the fifth and sixth wiring sections 233, 234 and extending across the first conductive wiring 22. The fourth spanning portion 236 is located between the third spanning portion 235 and the second contact 230.

As described above, the first conductive wiring 22 extends sequentially through the first wiring section 222, the first spanning portion 225, the second wiring section 223 and the second spanning portion 226 to the first end 221; and the second conductive wiring 23 extends sequentially through the fourth wiring section 232, the third spanning portion 235, the fifth wiring section 233 and the fourth spanning portion 236 to the second end 231.

In implementation, signals are input through the first input terminal $S_1$ and the second input terminal $S_2$, respectively. Therein, the signals input through the first input terminal $S_1$ are transmitted on the first conductive wiring 22, passing through the first wiring section 222, the first spanning portion 225, the second wiring section 223, the second spanning portion 226 and the third wiring section 224 and output to the ground terminal G via the central conductive wiring 21. On the other hand, the signals input through the second input terminal $S_2$ are transmitted on the second conductive wiring 23, passing through the fourth wiring section 232, the third spanning portion 235, the fifth wiring section 233, the fourth spanning portion 236 and the sixth wiring section 234 and output to the ground terminal G via the central conductive wiring 21. Since the inductance value is proportional to the area of a wiring loop, the second conductive wiring 23 has an inductance value greater than that of the first conductive wiring 22.

According to the present invention, since the first wiring section of the first conductive wiring and the fourth wiring section of the second conductive wiring are asymmetric to one another along the central conductive wiring, and the second wiring section of the first conductive wiring and the fifth wiring section of the second conductive wiring are asymmetric to one another along the central conductive wiring, the second conductive wiring can be designed to have an inductance value greater than that of the first conductive wiring. Therefore, the present invention provides an asymmetric differential inductor so as to avoid various limitations as could otherwise occur in circuit layout of a conventional center-tap differential inductor, thereby saving substrate space and better facilitating circuit layout.

The above-described descriptions of the detailed embodiments are intended to illustrate the preferred implementation according to the present invention but are not intended to limit the scope of the present invention. Accordingly, many modifications and variations completed by those with ordinary skill in the art will fall within the scope of present invention as defined by the appended claims.

What is claimed is:

1. An asymmetric differential inductor for being disposed on a substrate having a first input terminal, a second input terminal, a ground terminal and a central conductive wiring, in which the first input terminal and the second input terminal are disposed on left and right sides of the central conductive wiring, respectively, and the central conductive wiring has a central contact connecting the ground terminal and a central end opposite in position to the central contact, the asymmetric differential inductor comprising:

a first conductive wiring extending across the central conductive wiring so as to be spirally disposed on the substrate, and having a first contact connecting the first input terminal and a first end connecting the central end; and a second conductive wiring extending across the central conductive wiring and interlacing with the first conductive wiring so as to be spirally disposed on the substrate, and having a second contact connecting the second input terminal and a second end connecting the central end, wherein a portion of wiring sections of the second conductive wiring and a corresponding portion of wiring sections of the first conductive wiring disposed on the left and right of the central conductive wiring are asymmetric to one another.

2. The asymmetric differential inductor of claim 1, wherein the first conductive wiring spirally extends from the first contact to the first end in a clockwise manner, and the second conductive wiring spirally extends from the second contact to the second end in counterclockwise manner.

3. The asymmetric differential inductor of claim 1, wherein the second conductive wiring further comprises a third spanning portion and a fourth spanning portion extending across the first conductive wiring on the left side of the central conductive wiring.

4. The asymmetric differential inductor of claim 1, wherein the first conductive wiring further comprises a first spanning portion extending across the second conductive wiring and a second spanning portion extending across the second conductive wiring and the central conductive wiring.

5. The asymmetric differential inductor of claim 4, wherein the first conductive wiring further comprises a first wiring section and a second wiring section disposed on the left and right sides of the central conductive wiring, respectively, and in parallel to the central conductive wiring; and the second conductive wiring further comprises a fourth wiring section and a fifth wiring section disposed on the right and left sides of the central conductive wiring, respectively, and in parallel to the central conductive wiring, wherein the first and fourth wiring sections are asymmetric to one another along the central conductive wiring, and the second and fifth wiring sections are asymmetric to one another along the central conductive wiring.

6. The asymmetric differential inductor of claim 5, wherein the first conductive wiring extends sequentially through the first wiring section, the first spanning portion, the second wiring section and the second spanning portion to the first end.

7. The asymmetric differential inductor of claim 5, wherein the second conductive wiring further comprises a third spanning portion and a fourth spanning portion extending across the first wiring section of the first conductive wiring.

8. The asymmetric differential inductor of claim 7, wherein the second conductive wiring extends sequentially through the fourth wiring section, the third spanning portion, the fifth wiring section and the fourth spanning portion to the second end.

9. The asymmetric differential inductor of claim 5, wherein the first conductive wiring further comprises a third wiring section disposed on the left side of the central conductive wiring and in parallel to the central conductive wiring, and the second conductive wiring further comprises a sixth wiring section disposed on the right side of the central conductive wiring and in parallel to the central conductive wiring, wherein the third and sixth wiring sections are symmetric to one another along the central conductive wiring.

10. The asymmetric differential inductor of claim 9, wherein the first wiring section is located between the third and fifth wiring sections such that distance between the first and fifth wiring sections is greater than distance between the first and third wiring sections.

11. The asymmetric differential inductor of claim 9, wherein the second wiring section is located between the fourth and sixth wiring sections such that distance between the second and fourth wiring sections is greater than distance between the second and sixth wiring sections.

* * * * *